US007757622B2

(12) United States Patent
Vonli et al.

(10) Patent No.: US 7,757,622 B2
(45) Date of Patent: Jul. 20, 2010

(54) TRANSFER OF WHEELED OBJECTS

(75) Inventors: John Vonli, Laksevåg (NO); Ole Kristian Holen, Mandal (NO); Thomas Kjær, Mandal (NO); Peter Reed-Larsen, Mandal (NO)

(73) Assignee: Umoe Mandal AS, Mandal (NO)

( * ) Notice: Subject to any disclaimer, the term of this patent is extended or adjusted under 35 U.S.C. 154(b) by 214 days.

(21) Appl. No.: 11/919,711

(22) PCT Filed: May 9, 2006

(86) PCT No.: PCT/NO2006/000172

§ 371 (c)(1),
(2), (4) Date: Jan. 28, 2008

(87) PCT Pub. No.: WO2006/121342

PCT Pub. Date: Nov. 16, 2006

(65) Prior Publication Data

US 2009/0090288 A1 Apr. 9, 2009

Related U.S. Application Data

(60) Provisional application No. 60/678,805, filed on May 9, 2005.

(51) Int. Cl.
*B63B 35/44* (2006.01)

(52) U.S. Cl. ..... 114/258

(58) Field of Classification Search ..... 114/70, 114/231, 248, 258
See application file for complete search history.

(56) References Cited

U.S. PATENT DOCUMENTS

| | | | | | |
|---|---|---|---|---|---|
| 3,067,439 | A | | 12/1962 | Brush | |
| 3,069,862 | A | | 12/1962 | Ward | |
| 3,296,639 | A | | 1/1967 | Pawlus | |
| 3,320,918 | A | * | 5/1967 | Zalejski | 114/70 |
| 3,844,245 | A | | 10/1974 | Yamaguchi | |
| 3,871,317 | A | * | 3/1975 | Szpytman | 114/282 |
| 3,910,219 | A | * | 10/1975 | Ono et al. | 114/248 |
| 3,935,831 | A | | 2/1976 | Yamaguchi | |
| 4,688,607 | A | | 8/1987 | Wolcott | |
| 4,691,660 | A | | 9/1987 | Tornay | |
| 4,805,548 | A | | 2/1989 | Yamaguchi | |
| 5,050,522 | A | | 9/1991 | Yamaguchi et al. | |
| 5,067,429 | A | | 11/1991 | Castel et al. | |
| 6,050,747 | A | | 4/2000 | Midttveit et al. | |

FOREIGN PATENT DOCUMENTS

WO WO-00/15489 A1 3/2000

* cited by examiner

*Primary Examiner*—Stephen Avila
(74) *Attorney, Agent, or Firm*—Birch, Stewart, Kolasch & Birch, LLP

(57) ABSTRACT

According to the invention, a system is provided for connecting two vessels to each other or for connecting a vessel to a land-based structure for the transfer of objects. The system according to the invention comprises at least one projecting body adapted for attachment to one of the vessels and at least one receiving means adapted for attachment to the other vessel or to the land-based structure, the receiving means also comprising side members with recesses for cooperation with the projecting bodies. The invention also comprises a method for transferring material and a landing vessel for connecting to a cargo vessel.

11 Claims, 4 Drawing Sheets

TRANSFER OF WHEELED OBJECTS

Figure 1:
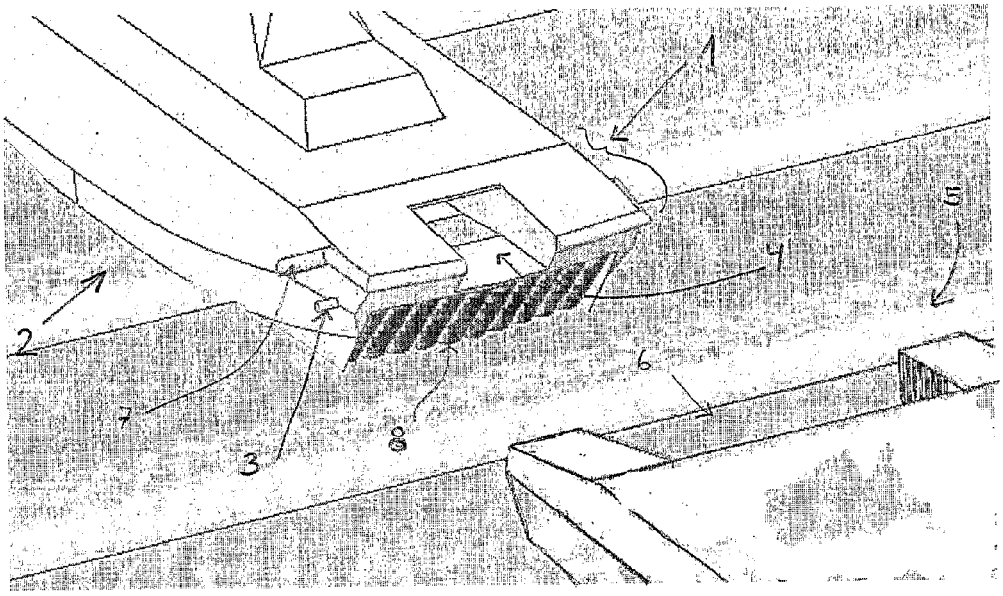

This application is the National Phase of PCT/NO2006/000172 filed on May 9, 2006, which claims priority under 35 U.S.C. 119(e) to U.S. Provisional Application No. 60/678,805 filed on May 9, 2005. The entire contents of which are hereby incorporated by reference.

The object of the present invention is to provide a simple way of transferring objects from a cargo vessel to land, via a landing vessel.

According to the prior art, the delivery of wheeled objects, including cars, trucks, trailers, trains, wheeled containers etc., to land is carried out in that a cargo vessel approaches land for direct transfer of the objects. Cargo vessels usually have a large volume below deck and therefore a technique of this kind requires a certain depth at the delivery location.

According to one aspect of the invention, a landing vessel is used for transferring objects from the cargo vessel to land or vice versa. The term 'landing vessel' refers to a vessel which carries cargo from the ocean-going cargo vessel and on to land. It may, for example, be a conventional ship which needs a dock in order to discharge its load or it may be a special landing craft which is intended to set the cargo down on the shore without the use of a quay.

In the case of wheeled objects or trucks for the transport of goods, one or both vessels will be equipped with ramps which permit transfer. The invention may also be used in connection with the transfer of liquid media, for example, oil or gas, via hoses.

The landing vessel and the cargo vessel are connected to one another for the transfer of the objects by means of the system according to the invention.

Known systems for connecting vessels relate to "tug-barge" connections as mentioned, e.g., in U.S. Pat. No. 4,688,607, U.S. Pat. No. 3,844,245, U.S. Pat. No. 3,935,831, U.S. Pat. No. 4,805,548, U.S. Pat. No. 5,050,522, U.S. Pat. No. 4,691,660. These known systems are adapted for force transmission between the vessels, as one vessel will tow or push another. The systems require the vessels to be stationary when the connection takes place.

The object of the invention is to provide a system for connecting two vessels to each other which does not have the aforementioned drawbacks.

One of the objects of the invention is to provide a connecting system for connecting two vessels to each other for the purpose of transferring cargo from one vessel to the other.

Another object of the invention is to provide a system for delivering wheeled objects at locations that are difficult for a cargo vessel to reach.

Another object of the invention is to provide a system which allows connection of vessels even in heavy seas.

Another object of the invention is to provide a system wherein the movement of the connection is negligible even if the vessels pitch relative to one another.

Another object of the invention is to provide a system which does not require precision in the position of the vessels, and also which allows connection when the vessels are in motion.

According to the invention, a system is provided for connecting two vessels to each other or for connecting a vessel to a land-based structure for the transfer of objects. The system according to the invention comprises at least one projecting body adapted for attachment to one of the vessels and at least one receiving means adapted for attachment to the other vessel or to the land-based structure, the receiving means also comprising side members with recesses for cooperation with the projecting bodies.

The projecting bodies may, for example, be bars, bolts, shafts or balls.

In one embodiment of the invention, the recesses in the side members are funnel-shaped and they run essentially horizontally, with a lower edge running upward towards a U-shaped bottom area, and an upper edge which may be horizontal or slightly downward-sloping in the direction of the same bottom area. In one embodiment of the invention, receiving holes for the projecting bodies are provided in the bottom area, the receiving holes in one embodiment of the invention allowing the bodies to rotate in the holes about an axis of rotation. The terms "upward" and "downward" refer to an inclined position relative to a horizontal plane.

In one embodiment of the invention, the bodies are adapted to slide across the lower edge of the recesses and into securement in the holes of the receiving means. Thus, the connection of the vessels is guided by the lower edge of the recesses and the projecting bodies.

In one embodiment of the invention that is adapted for transfer of wheeled objects, the system comprises a loading ramp for mounting on one of the vessels. In a preferred variant of this embodiment, the axis of rotation of the projecting bodies should correspond with the pivotal axis of the loading ramp. As will be understood, the projecting bodies in this embodiment run essentially in a direction that is perpendicular to the direction of travel of the vessels. A connection of this kind makes the movement of the loading ramp on the cargo vessel deck negligible even if the vessels pitch relative to each other.

The vessels are thus locked to each other so as to be connected as a transverse hinge. Only independent pitch motion, other types of motions are arrested/interlocked.

In a preferred embodiment, the system according to the invention will be arranged so that the projecting bodies and the loading ramp are located on the landing vessel whilst the receiving part is located on the cargo vessel. It is possible to implement the invention in the reverse manner, and it is also possible to have the projecting bodies and the loading ramp on different ships. This alternative calls for greater precision in positioning the vessels relative to each other because the ramp and the fastening devices are not on the same vessel.

In a preferred embodiment of the invention, the landing vessel is an SES vessel, and thus allows simple height adjustment.

The invention also provides a method for transferring equipment from a cargo vessel, which may be making headway through the water, to a landing vessel and thence to the shore or a quay. The method comprises connecting the landing vessel to the cargo vessel by means of a system according to the invention, transferring cargo between the vessels and disconnecting the vessels.

The invention is particularly suitable for Ro/Ro transfer of cargo, i.e., for use with cargo ships intended for rolling cargo where loading and unloading can take place in that the cargo rolls aboard or ashore on its own wheels.

Disconnection will, for example, take place in that the projecting bodies are retracted (for example, by means of a hydraulic mechanism).

In one embodiment thereof, the invention comprises a method for transferring wheeled objects from a cargo vessel to a landing vessel or vice versa, comprising connecting the vessels by means of a system according to the invention, and, after the vessels have been connected, deploying a ramp from the landing vessel onto a deck at the stern of the cargo vessel in order to move wheeled objects (optionally also fuel oil and other supplies using hoses with standardised connectors). The method also comprises, once loading is completed, moving the ramp back, releasing the locking mechanism and moving the vessel out of the recess.

The invention also relates to a landing vessel for connection to a cargo vessel comprising a loading ramp in the bow and projecting bodies for insertion into receiving means on the cargo vessel. In one embodiment of this invention, the bodies are two transverse bolts and the receiving means comprises a recess in the after end of the stern. In a preferred embodiment thereof, the recess forms an elastic support for the bodies. This can, for example, be implemented in that the recess is a separate structure which is supported on elastic understructures.

In one embodiment of the invention, the bow of the landing vessel and the stern of the cargo vessel are adapted to each other and they are both of tapered configuration. There may also be a fender system on at least one of the vessels for the purpose of distributing impact loads during the connecting operation.

In one embodiment of the invention, the bolts are fixed and optionally through-going or retractable (for insertion into holes or grooves).

Although different features of the invention have been described in connection with different embodiments thereof, it will be clear that these features can be combined in other embodiments.

The invention has, inter alia, the following advantages compared with the prior art: the connection can take place in open waters and when the vessels are in motion; the connection in one embodiment of the invention is made for the transfer of rolling cargo and optionally fuel oil/other supplies; the connection may last for a short time (i.e., about two hours at a time) and be made during favourable weather conditions; the connection will not be used to "push" or tow the other vessel; in one embodiment of the invention, the landing vessel is an SES vessel; the projecting bodies (for example, locking bolts) may be fixed on the landing vessel; the recess in the landing vessel is essentially horizontal, but with a funnel-shaped opening.

As mentioned above, the system according to the invention in one embodiment is adapted for transferring wheeled objects between the vessels. Because the connection is fixed for all motions with the exception of pitch, it is possible to use a standard ramp solution in such a system.

If the landing vessel is not an SES vessel, it will be possible to adjust the position of the projecting bodies relative to the receiving means by adjusting the height of the receiving means (for example, by connecting it to vertical rails) or by ballasting the vessels.

The invention will be described in more detail below by means of an embodiment shown in the drawings, wherein:

FIG. 1 shows foreship 1 of a landing vessel 2 having fastening devices (locking bolts 3) and a hatch opening 4. The figure also shows the cargo vessel 5 with notch 6. The foreship 1 of the landing vessel 2 is adapted to the shape of the notch 6 on the cargo ship 5. The landing vessel 2 is equipped with fendering 7 and 8 is the bow skirt.

Figure 2:
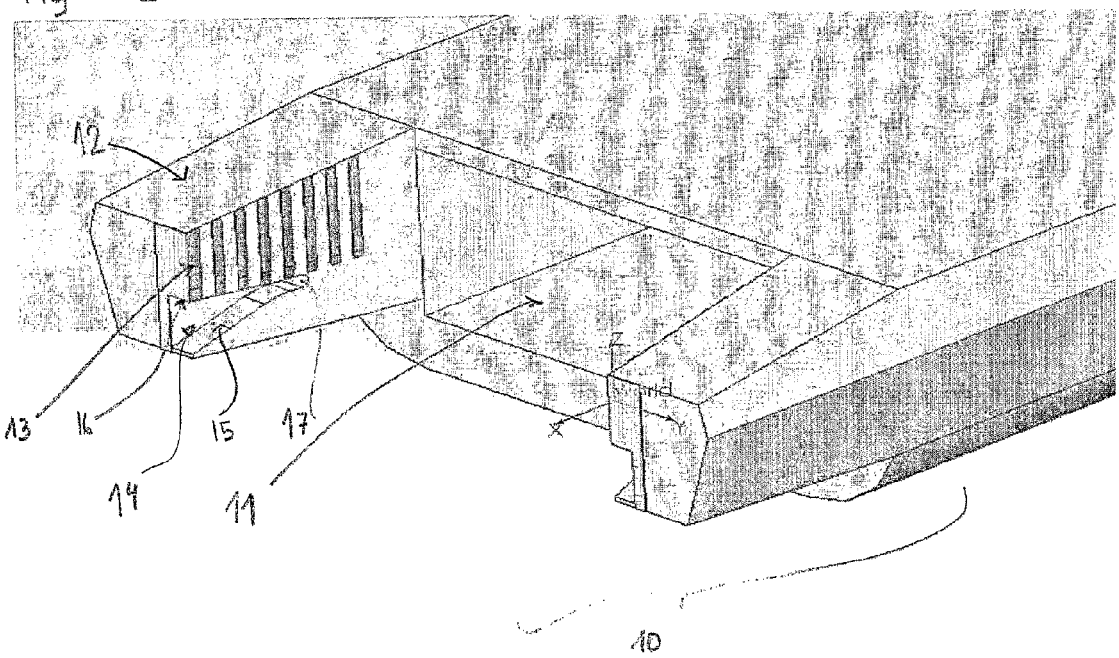

FIG. 2 shows the stern 10 of the cargo vessel 5 with hold 11. Two side members or panels 12 with fendering system 13 and funnel-shaped recesses 14 are attached to the stern. The recesses 14 are funnel-shaped with a lower edge 15 running upward towards the bow of the cargo vessel 5 and an upper edge 16 running essentially horizontally or slightly downward. The edges 15 and 16 meet at a bottom area 17. As will be apparent from the subsequent figures, the bolt 3 will slide across the lower edge 16 until it reaches the bottom area 17. The bottom area 17 cooperates with the bolt 3 to secure it, or optionally to allow rotation of the bolt 3 relative to the bottom area 17. Cooperation can be effected by means of locking mechanisms, e.g., a recess in the bottom area and bolts 3 that are pressed outwards and into the recess. The side members 12 may be an integral part of the ship or may be retrofitted.

Figure 3:
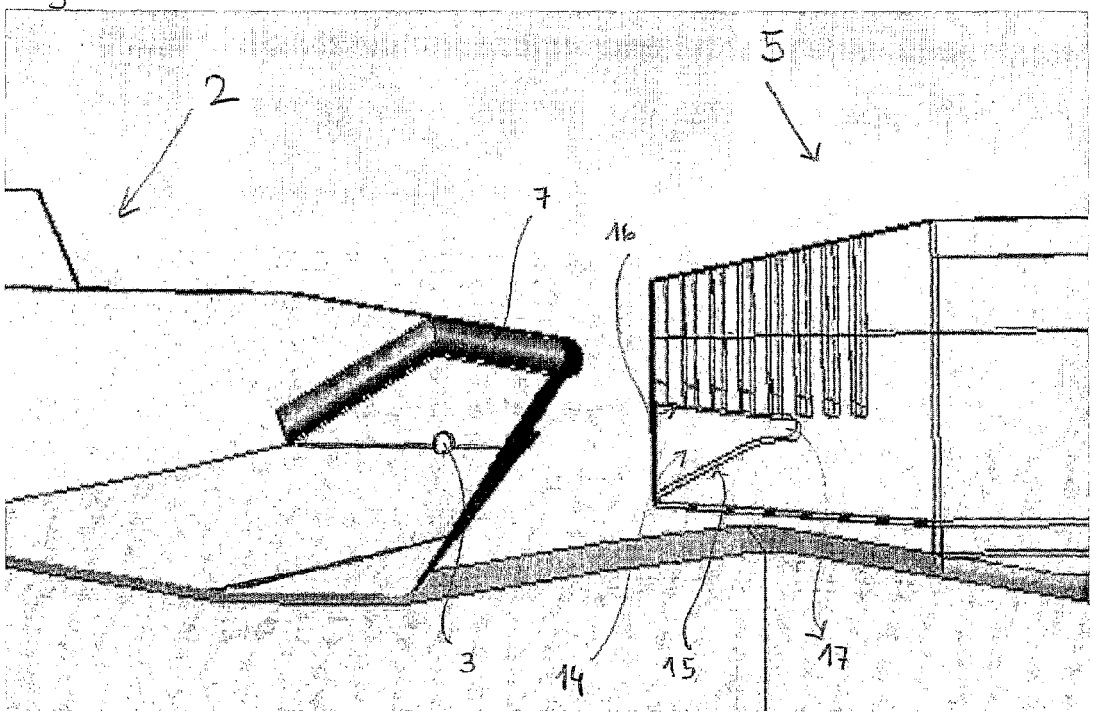

FIG. 3 shows the landing vessel 2 with fender 7 and locking bolt 3 on its way in towards the after end of the cargo ship 5.

Figure 4:
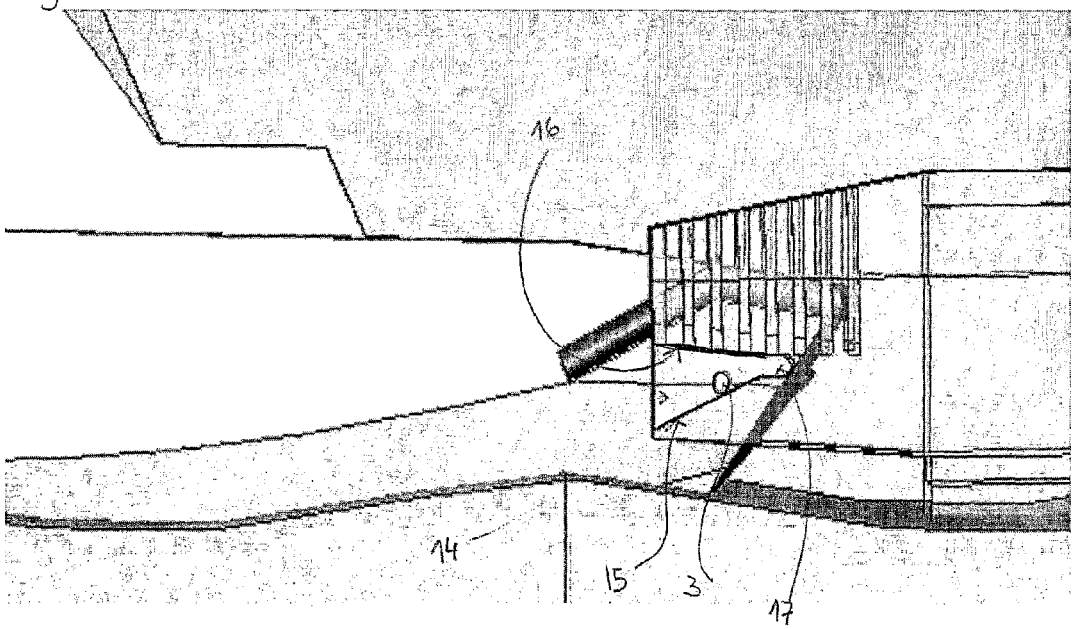

FIG. 4 shows the landing vessel 2 on its way into the notch 6. The locking bolt 3 has entered the funnel-shaped recess 14 and is being guided in towards the bottom 17 or towards the horizontal edge 16 where it will be locked, but with the freedom to rotate.

Figure 5:
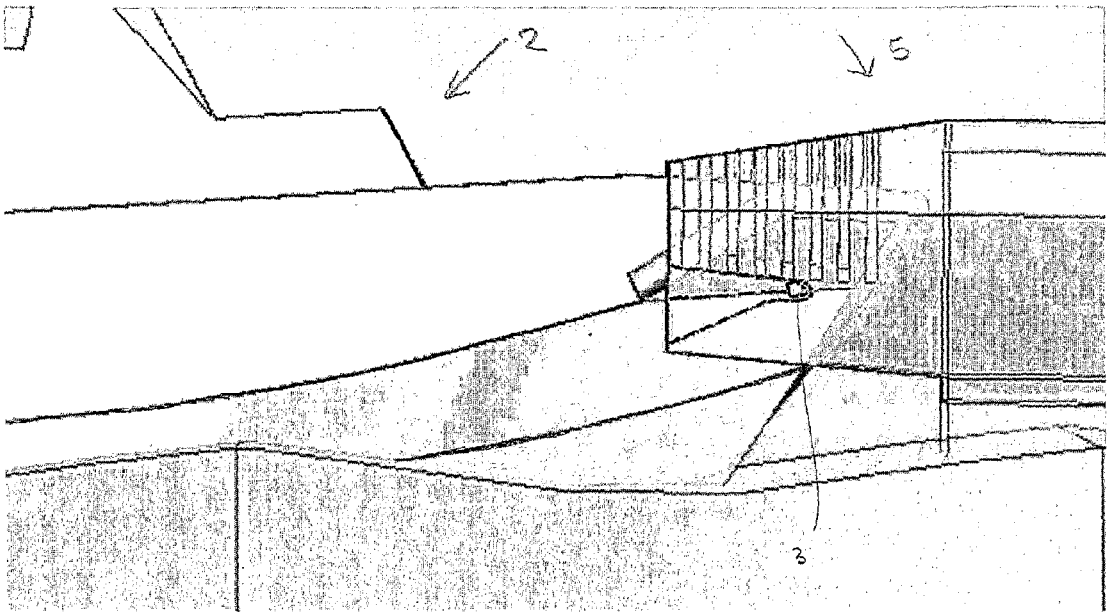

FIG. 5 shows the situation in which the landing vessel 2 has come into place and the locking bolt 3 is locked in place. The vessels 2 and 5 are now secured in all degrees of freedom, with the exception of pitch.

Figure 6:
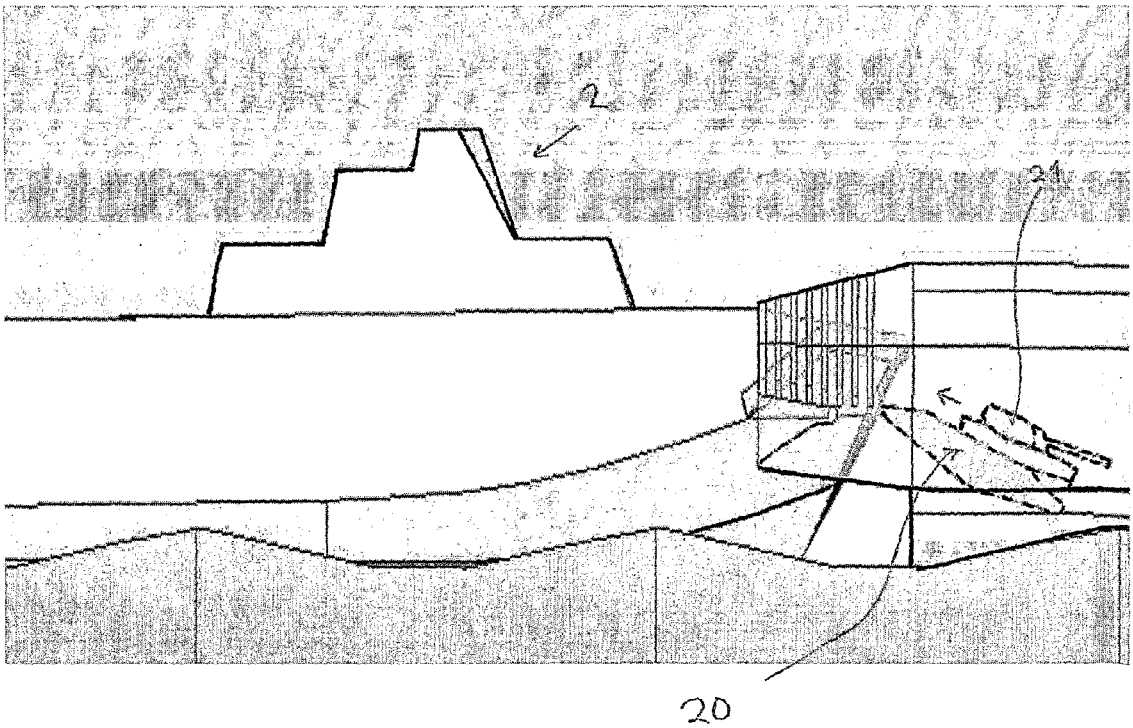

FIG. 6 shows how the landing ramp 20 is unfolded and rolling stock 21 can be driven aboard the landing vessel 2.

Figure 7:
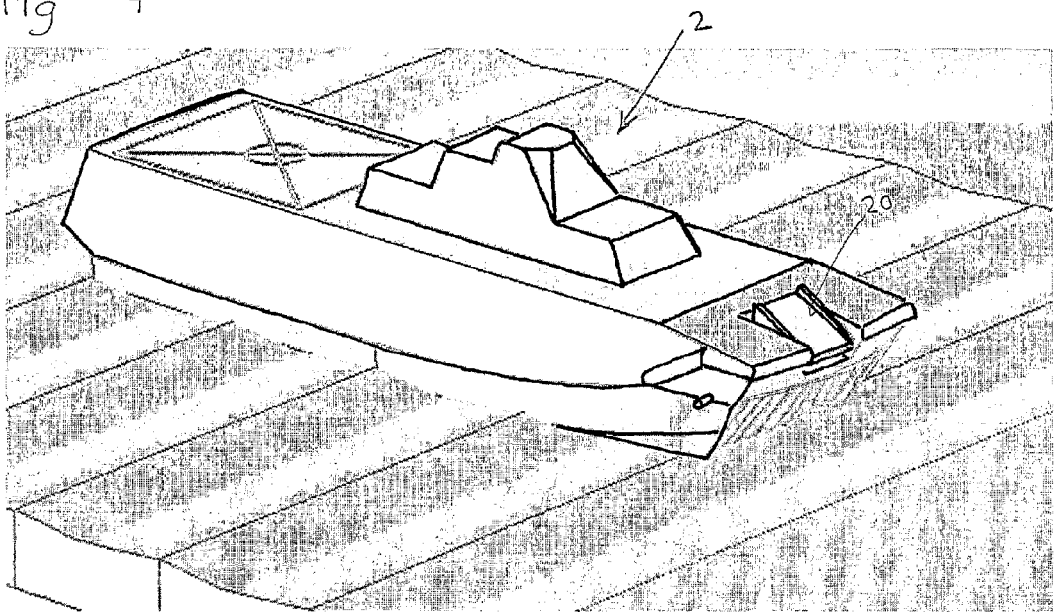

FIG. 7 shows the landing vessel 2 by the shore. The landing ramp 20 is in the process of being deployed.

Figure 8:
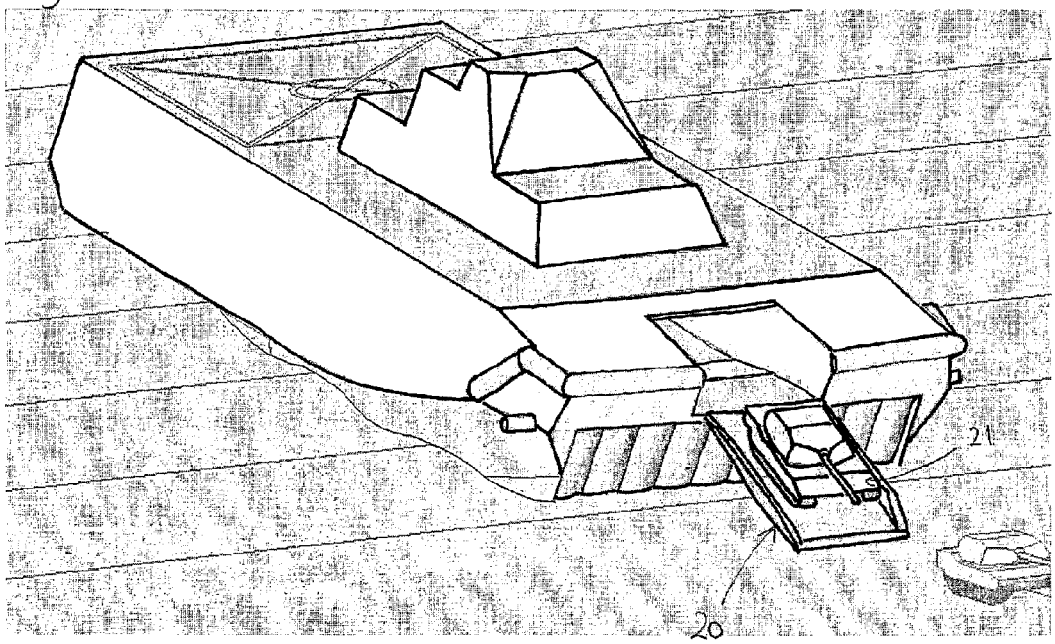

FIG. 8 shows the landing vessel 2 where the landing ramp 20 has been deployed and rolling stock 21 is rolling ashore.

As can be seen, the invention allows simple and rapid connection of two vessels in motion. The system has low requirements as regards precision of the position of the one vessel relative to the other, and results in high flexibility as regards where the cargo can be delivered since the requirements for depth at the delivery location have been eliminated.

As mentioned above, the landing vessel in one embodiment of the invention is an SES vessel (Surface Effect Ship), i.e., that the freeboard can be adjusted and thus adapted to different draughts of the cargo vessel by adjusting the pressure in the air cushion between the hulls. During landing, the landing vessel is maneuvered with its bow in towards the shore with a selected cushion pressure. Anchors can be deployed from the stern to keep the vessel in position, and optionally also to pull the vessel out from the shore after the landing operation has been completed. The use of anchors is appropriate on gradually sloping shores in order to reduce the use of propellers. Thus, the danger of the propellers sucking up pebbles and sand from the bottom is lessened.

Optionally, the landing vessel may be equipped with retractable legs (like a mobile crane) in the bow for difficult shore conditions.

The landing vessel may also be equipped with an automatic positioning system for the actual connecting operation (integrated locally and a maneuvering system using propellers in the stern and bow thruster(s) in the foreship, optionally with control of cushion pressure and ballast system).

The system according to the invention may also be used to transport rolling stock from land (shore or quay) and back to the cargo vessel at sea.

The invention claimed is:

1. A system for connecting a first vessel to a second vessel or to a land-based structure for transferring objects to and from the first vessel, comprising projecting bodies adapted for attachment to the first vessel and receiving means adapted for attachment to the second vessel or to the land-based structure, the receiving means comprising side members having recesses for cooperation with the projecting bodies, wherein the recesses in the side members are funnel-shaped with a lower edge running upward relative to a horizontal plane and towards a U-shaped bottom area of the recesses, the bottom area being adapted to the shape of the projecting bodies, and an upper edge that is horizontal or slightly downward-sloping relative to a horizontal plane and in the direction of the same bottom area.

2. The system according to claim 1, wherein the projecting bodies are bars, bolts, shafts and/or balls.

3. The system according to claim 1, wherein in the bottom area there are provided receiving holes for the projecting bodies, the receiving holes allowing the bodies to rotate in the holes.

4. The system according to claim 3, wherein the bodies are adapted to slide across the lower edge of the recesses and into securement in the holes of the receiving means.

5. The system according to one of the preceding claims, further comprising a ramp for the transfer of wheeled objects and for positioning in connection with the bodies.

6. The system according to claim 5, wherein the centre line or axis of rotation of the bodies corresponds with the pivotal axis of the ramp.

7. The system according to claim 6, wherein the landing vessel is an SES vessel.

8. A method for transferring materials between a first vessel and a second vessel or between a first vessel and a land-based structure, comprising connecting the landing vessel or the land-based structure to the cargo vessel by means of a system according to claim 1, transferring cargo and disconnecting the cargo vessel from the landing vessel or the land-based structure.

9. The method according to claim 8, further comprising, after the vessels have been connected, deploying a ramp from the first vessel onto a deck at the stern of the second vessel, driving wheeled objects between the vessels, then releasing the locking mechanism and moving the cargo vessel out of the recess.

10. A landing vessel for connecting to a cargo vessel, comprising a loading ramp in the bow and projecting bodies for insertion into receiving means on the cargo vessel, the receiving means include side members having recesses for cooperation with the projecting bodies, wherein the recesses in the side members are funnel-shaped with a lower edge running upward relative to a horizontal plane and towards a U-shaped bottom area of the recesses, the bottom area being adapted to the shape of the projecting bodies, and an upper edge that is horizontal or slightly downward-sloping relative to a horizontal plane and in the direction of the same bottom area.

11. The landing vessel according to claim 10, wherein the projecting bodies are two transverse bolts and the recesses are in the after end of the stern, and the recesses form elastic supports for the projecting bodies.

* * * * *